US011518173B2

(12) United States Patent
Kudo et al.

(10) Patent No.: US 11,518,173 B2
(45) Date of Patent: Dec. 6, 2022

(54) LIQUID TANK AND LIQUID EJECTING APPARATUS

(71) Applicant: SEIKO EPSON CORPORATION, Tokyo (JP)

(72) Inventors: Shoma Kudo, Shiojiri (JP); Yusuke Hirasawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/407,696

(22) Filed: Aug. 20, 2021

(65) Prior Publication Data

US 2022/0055370 A1 Feb. 24, 2022

(30) Foreign Application Priority Data

Aug. 21, 2020 (JP) ..... JP2020-139956

(51) Int. Cl.
*B41J 2/175* (2006.01)
*B41J 2/14* (2006.01)

(52) U.S. Cl.
CPC ..... *B41J 2/17513* (2013.01); *B41J 2/17523* (2013.01); *B41J 2/17553* (2013.01); *B41J 2002/14419* (2013.01)

(58) Field of Classification Search
CPC .... B41J 2/175; B41J 2/17506; B41J 2/17509; B41J 2/17513; B41J 2/1752; B41J 2/17523; B41J 2/17553; B41J 2/17596; B41J 2002/14419
See application file for complete search history.

(56) References Cited

U.S. PATENT DOCUMENTS 10,723,134 B2 7/2020 Koase et al.
2010/0013896 A1* 1/2010 Ishizawa ..... B41J 2/17566 347/86

FOREIGN PATENT DOCUMENTS

JP 2018-202655 A 12/2018
JP 108973335 * 12/2018 ..... B41J 2/175

* cited by examiner

*Primary Examiner* — Anh T Vo
(74) *Attorney, Agent, or Firm* — Oliff PLC

(57) ABSTRACT

A liquid tank includes: a liquid supply section; a liquid chamber; a liquid-communication flow path an air-communication flow path. The liquid-communication flow path has, in a liquid flow direction from the liquid chamber toward the liquid ejecting head: an upstream end coupled to the liquid chamber; an upward flow path located downstream of the upstream end and extending upward in the attached state; a downward flow path located downstream of the upward flow path and extending downward in the attached state; and a downstream end located downstream of the downward flow path and coupled to the liquid supply section and the air-communication flow path. The liquid-communication flow path has, at an intermediate position thereof, a narrow portion in which the sectional area of the liquid-communication flow path is small.

5 Claims, 12 Drawing Sheets

LIQUID TANK AND LIQUID EJECTING APPARATUS

The present application is based on, and claims priority from JP Application Serial Number 2020-139956, filed Aug. 21, 2020, the disclosure of which is hereby incorporated by reference herein in its entirety.

BACKGROUND

1. Technical Field

The present disclosure relates to a liquid tank and a liquid ejecting apparatus.

2. Related Art

JP-A-2018-202655 describes a known liquid tank that includes: a liquid supply section that supplies liquid to a liquid ejecting head; a first liquid chamber that stores liquid to be supplied to the liquid supply section; a liquid-communication flow path that couples between the first liquid chamber and the liquid supply section and through which the liquid in the first liquid chamber can be supplied to the liquid supply section; and an air-communication flow path that couples the first liquid chamber and the liquid supply section and through which air can flow between the first liquid chamber and the liquid supply section.

In this liquid tank, when a pump of a maintenance unit provided in a printer, which is an example of a liquid ejecting apparatus, is driven, the liquid is discharged from the first liquid chamber toward the liquid ejecting head through the liquid-communication flow path and the liquid supply section.

When liquid discharging of multiple liquid tanks is performed with a single pump, the flow rate of the liquid in the liquid-communication flow path in each liquid tank decreases. Hence, to compensate for the decrease in the flow rate, it is necessary to reduce the sectional area of the liquid-communication flow path, that is, to make the flow path narrower.

However, when the sectional area of the liquid-communication flow path is uniformly reduced, air (bubbles) that has entered the liquid-communication flow path is likely to be trapped when, for example, the liquid tank is tilted. Another problem is that the air in the liquid-communication flow path may flow toward the liquid supply section at an unexpected time during print processing.

When the bubbles that have flowed out to the liquid supply section move to the liquid ejecting head, an ejection defect, such as failure to eject liquid from the liquid ejecting head, may occur.

SUMMARY

According to an aspect of the disclosure, a liquid tank is attachable to a liquid ejecting apparatus having a liquid ejecting head and includes: a liquid supply section that supplies liquid to the liquid ejecting head; a liquid chamber that can store the liquid to be supplied to the liquid supply section; a liquid-communication flow path that couples the liquid chamber and the liquid supply section, through which the liquid stored in the liquid chamber can be supplied to the liquid supply section, and that forms an upwardly projecting flow path in an attached state in which the liquid tank is attached to the liquid ejecting apparatus; and an air-communication flow path that couples the liquid chamber and the liquid supply section, through which air can flow between the liquid chamber and the liquid supply section, and that is coupled, in the attached state, to the liquid chamber at a position above a coupling position between the liquid-communication flow path and the liquid chamber. The liquid-communication flow path has, in a liquid flow direction from the liquid chamber toward the liquid ejecting head: an upstream end coupled to the liquid chamber; an upward flow path located downstream of the upstream end and extending upward in the attached state; a downward flow path located downstream of the upward flow path and extending downward in the attached state; and a downstream end located downstream of the downward flow path and coupled to the liquid supply section and the air-communication flow path. The liquid-communication flow path has, at an intermediate position thereof, a narrow portion in which the sectional area of the liquid-communication flow path is small.

According to an aspect of the disclosure, a liquid ejecting apparatus includes: the liquid tank; and a liquid ejecting head that ejects liquid supplied from the liquid tank.

DESCRIPTION OF EXEMPLARY EMBODIMENTS

1. Structure of Liquid Ejecting Apparatus 1

Figure 1:
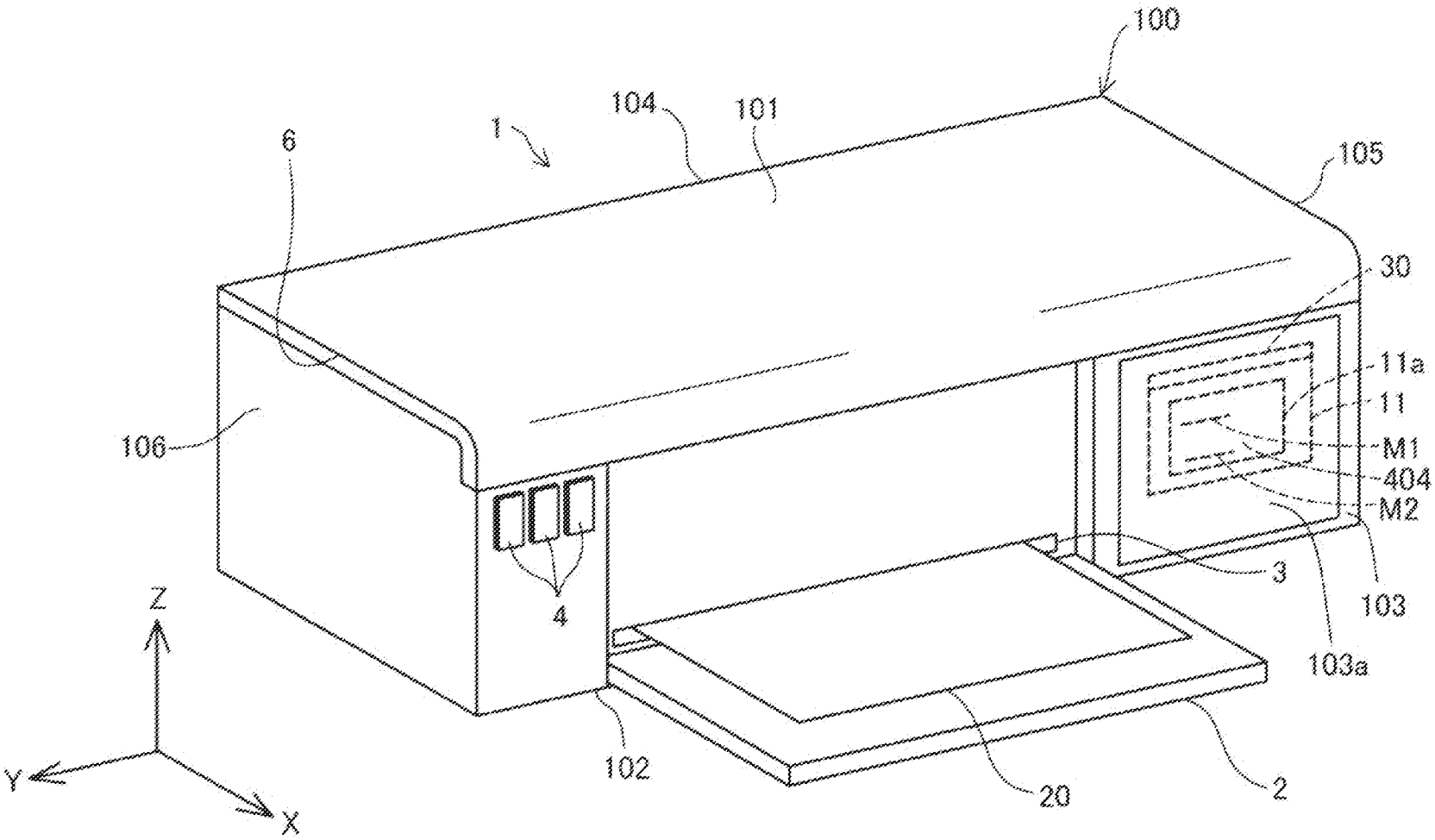
FIG. 1 is an external view showing the structure of a liquid ejecting apparatus.

FIG. 1 shows an exterior of a liquid ejecting apparatus 1 having a liquid tank 30. FIG. 1 includes three spatial axes, the X, Y, and Z axes, that are perpendicular to one another. The liquid ejecting apparatus 1 is installed on a surface parallel to the X axis and the Y axis (XY plane).

The liquid ejecting apparatus 1 is a so-called an ink jet printer, which prints on a recording medium 20, such as a sheet, by ejecting liquid (for example, ink).

The liquid ejecting apparatus 1 includes an outer shell 100, which serves as an external surface. The outer shell 100 has a substantially rectangular parallelepiped shape and includes: a top surface (a first surface, a first wall) 101; a bottom surface (a second surface, a second wall) 102; a front surface (a third surface, a third wall) 103; a back surface (a fourth surface, a fourth wall) 104; a right side surface (a fifth surface, a fifth wall) 105; and a left side surface (a sixth surface, a sixth wall) 106. The top surface 101 and the bottom surface 102 are opposed to each other in the Z-axis direction. The front surface 103 and the back surface 104 are opposed to each other in the X-axis direction. The right side surface 105 and the left side surface 106 are opposed to each other in the Y-axis direction. The front surface 103, the back surface 104, the right side surface 105, and the left side surface 106 are substantially perpendicular to the installation surface of the liquid ejecting apparatus 1. The top surface 101 and the bottom surface 102 are substantially parallel to the installation surface of the liquid ejecting apparatus 1. In this embodiment, the expressions "substantially perpendicular" and "substantially parallel" not only mean "exactly perpendicular" and "exactly parallel", but also mean "almost perpendicular" and "almost parallel". Hence, the surfaces 101 to 106 do not necessarily have to be exactly flat surfaces but may have recesses, projections, etc., and the surfaces 101 to 106 may be almost perpendicular to or parallel to the installation surface in external view.

The liquid ejecting apparatus 1 also includes a front cover 2, an output port 3, operation sections 4, and a top cover 6. The front cover 2 constitutes a portion of the front surface 103. The front cover 2 is pivoted at a lower end thereof and can be opened and closed by rotating an upper end thereof. In FIG. 1, the front cover 2 is open. The output port 3 is exposed by opening the front cover 2.

The recording medium 20 is output from the output port 3. The recording medium 20 may be disposed on a tray (not shown) provided on the back surface 104 side. While the recording medium 20 disposed on the tray is transported into the outer shell 100, the liquid is ejected onto the recording medium 20. In this way, printing on the recording medium 20 is performed.

The operation sections 4 are buttons via which a user inputs various operations. The various operations include, for example, an operation to start printing with the liquid ejecting apparatus 1 and an operation to execute discharging action (described below), in which fluid in the liquid tank is discharged outside.

The top cover 6 serves as the top surface 101. The top cover 6 is pivoted at an end on the back surface 104 side and can be opened and closed by rotating an on the front surface 103 side. By opening the top cover 6, a user can check the internal state of the liquid ejecting apparatus 1, attach or remove the liquid tank 30, and pour the liquid into the liquid tank 30.

The front surface 103 has an apparatus window 103*a* in an area overlapping a home position of a carriage 19 in the Y-axis direction (i.e., a carriage 19 reciprocation direction, described below). In this embodiment, the apparatus window 103*a* is provided at a position different from the position of the front cover 2, more specifically, to the −Y side of the front cover 2. The apparatus window 103*a* allows a user to view, from the outside, a front surface (view surface) 404 of the liquid tank 30 attached to the carriage 19 located at the home position. The front surface 404 has indicators M1 and M2. The apparatus window 103*a* may be, for example, a transparent member or a through-hole penetrating the front surface 103. The indicators M1 and M2 are elements showing the reference liquid levels in the liquid tank 30. In this embodiment, the indicator M1 shows the upper-limit reference, and the indicator M2 shows the lower-limit reference. The indicators M1 and M2 will be described in more detail below. The apparatus window 103*a* does not necessarily have to be provided in the front surface 103 as long as the front surface 404 of the liquid tank 30 located at the home position can be viewed from the outside. For example, the apparatus window 103*a* may be provided in the top surface 101. In that case, the user can view the front surface 404 of the liquid tank 30 by viewing the apparatus window 103*a* from the upper front side.

Figure 2:
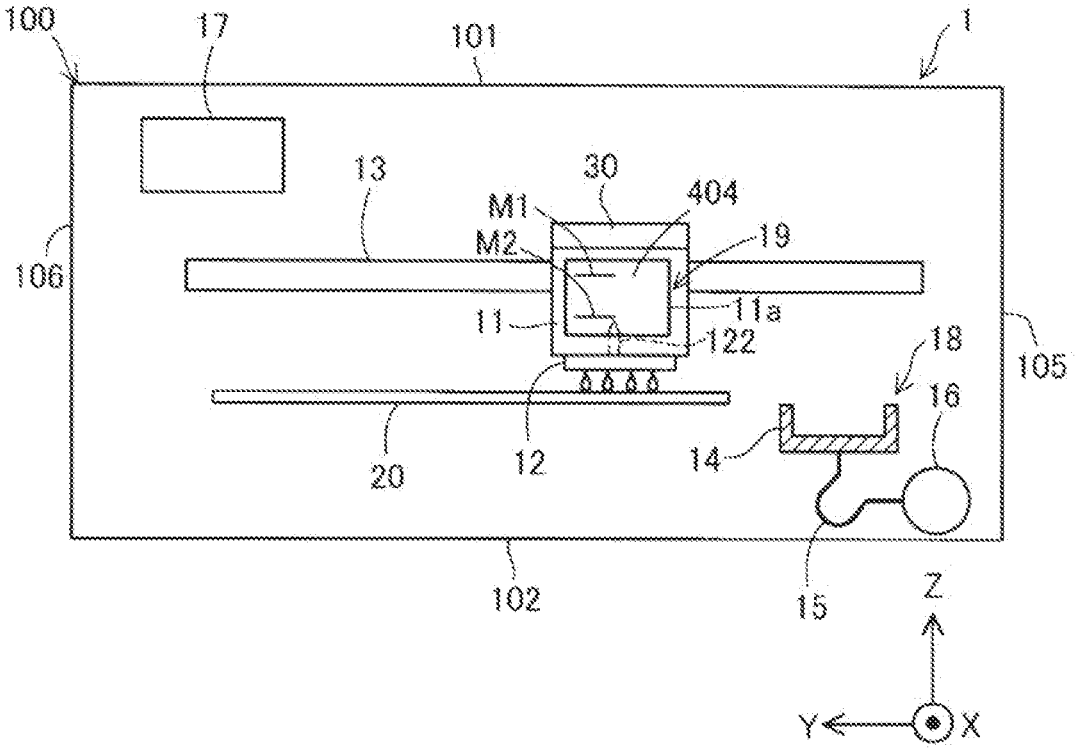
FIG. 2 schematically shows the internal structure of the liquid ejecting apparatus.

FIG. 2 schematically shows the internal structure of the liquid ejecting apparatus 1. The liquid ejecting apparatus 1 includes, inside the outer shell 100, a controller 17 and the carriage 19 having a liquid ejecting head 12. The liquid tank 30 is removably loaded on the carriage 19. The controller 17 controls various operations (for example, printing) of the liquid ejecting apparatus 1. The controller 17 includes, for example, a central processing unit (CPU), a memory, and a control circuit. The CPU is an arithmetic processing unit. The memory is a storage device that provides an area for storing programs for the CPU, a work area, and the like and includes storage elements, such as a random-access memory (RAM), an electrically erasable, programmable read-only memory (EEPROM), and the like.

The carriage 19 has an attachment section 11 disposed on the liquid ejecting head 12. The attachment section 11 has the shape of a box that is open on, for example, the +Z side and forms an attachment space to which the liquid tank 30 is attached. In the attachment section 11, a liquid-introduction needle 122 projects in the +Z direction from a bottom surface delimiting the attachment space. The liquid-introduction needle 122 is coupled to the liquid tank 30. The liquid-introduction needle 122 is hollow and has, at the tip thereof, a communication hole communicating with the inside thereof. The liquid supplied from the liquid tank 30 through the communication hole in the liquid-introduction needle 122 flows through the inside of the liquid-introduction needle 122. The liquid ejecting head 12 communicates with the liquid-introduction needle 122 and ejects the liquid supplied from the liquid tank 30 onto the recording medium 20.

The attachment section 11 can hold a plurality of liquid tanks 30. When a plurality of liquid tanks 30 are used, for example, the liquid tanks 30 store different types (for example, the color, such as cyan, magenta, yellow, and black, and the colorant, such as pigment and dye) of liquids.

The attachment section 11 has an attachment-section window 11*a* that allows a user to view the front surface (view surface) 404, including the indicators M1 and M2. The attachment-section window 11*a* is provided at a position facing at least the indicator M1 on the liquid tank 30. The attachment-section window 11*a* may be, for example, a transparent member or a through-hole penetrating a wall constituting the attachment section 11. When the carriage 19 is located at the home position, the user can view the front surface (view surface) 404, which has the indicators M1 and M2, through the apparatus window 103*a* (FIG. 1) and the attachment-section window 11*a*.

The carriage 19 holding the liquid ejecting head 12 is driven by a driving mechanism (not shown) and repeatedly reciprocates over the recording medium 20 while being guided by a guide rail 13 extending in the Y-axis direction. The liquid ejecting apparatus 1 has a transport mechanism that transports the recording medium 20 toward the output port 3 (FIG. 1). As a result of the liquid ejecting head 12 ejecting the liquid in conjunction with the reciprocation of the carriage 19 and the transportation of the recording medium 20, an image or the like is printed on the recording medium 20.

The liquid tank 30 stores the liquid to be supplied to the liquid ejecting head 12. The liquid tank 30 is removably coupled to the liquid-introduction needle 122. By coupling the liquid-introduction needle 122 to the liquid tank 30, the liquid in the liquid tank 30 can flow through the liquid-introduction needle 122.

The liquid ejecting apparatus 1 also has a discharge section 18 that performs an operation for periodically removing fluid (for example, liquid and air) from the liquid ejecting head 12 by suction (discharging action).

The discharge section 18 is disposed inside the outer shell 100. The discharge section 18 includes a cap 14, a suction tube 15, and a suction pump 16. While the liquid ejecting apparatus 1 is not performing printing, the carriage 19 is located at the home position, which is outside the area in which the carriage 19 moves during printing.

The cap 14 is a bottomed box-shaped member disposed at a lower part of the home position. The cap 14 can be moved in the Z-axis direction (top-bottom direction) by a lifting mechanism (not shown). When the cap 14 is lifted upward, the cap 14 is pressed against the bottom surface of the liquid ejecting head 12. As a result, the cap 14 forms a closed space so as to cover nozzle holes provided in the bottom surface of the liquid ejecting head 12 (closed-space state). This closed space suppresses drying of the liquid in the liquid ejecting head 12 (nozzles).

The suction tube 15 communicates between the cap 14 (more specifically, a through-hole penetrating the bottom surface of the cap 14) and the suction pump 16. By driving the suction pump 16 in the closed-space state, the suction pump 16 sucks the fluid (liquid and air) in the liquid ejecting head 12 and the liquid tank 30 through the suction tube 15. By this operation, initial liquid filling of the liquid ejecting head 12 and removal of deteriorated (dried and thickened) liquid in the liquid ejecting head 12 by suction are performed.

2. Outline of Liquid Tank 30

Figure 3:
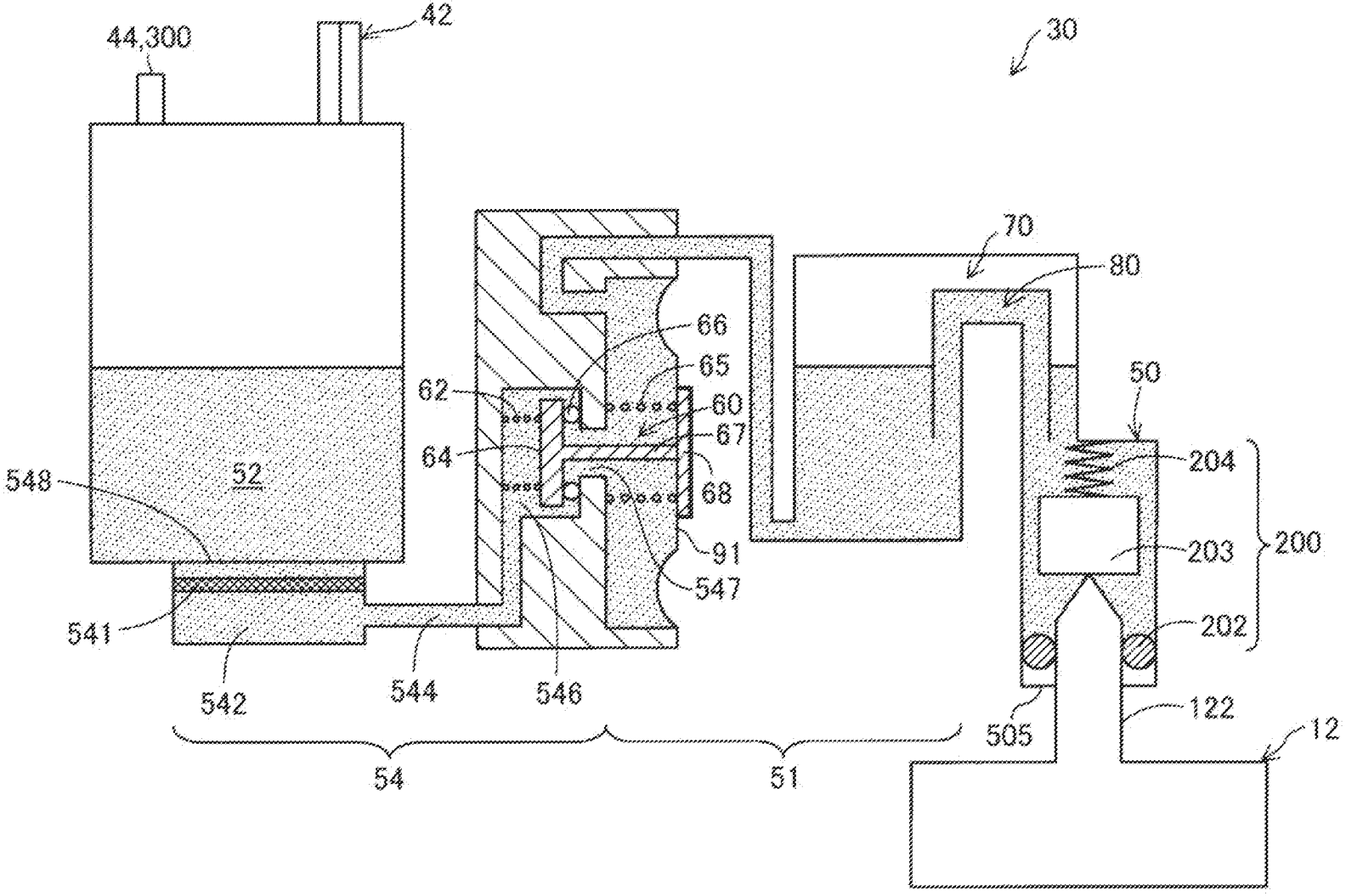
FIG. 3 is a conceptual diagram showing a flow path structure of a liquid tank.

FIG. 3 is a conceptual diagram mainly showing the flow path structure of the liquid tank 30. Herein, the expressions "upstream" and "downstream" used in the description below are based on the flow direction of the liquid flowing from the liquid tank 30 toward the liquid ejecting head 12. In FIG. 3, dotted areas show the areas where the liquid exists.

The liquid tank 30 has a liquid flow path including, from upstream, a second liquid chamber 52, a coupling flow path 54, a first liquid chamber 51 (corresponding to a liquid chamber), a liquid-communication flow path 80, and a liquid supply section 50. The liquid tank 30 has an air flow path including an air-communication flow path 70.

The liquid can be poured into the second liquid chamber 52 from the outside through a liquid injection portion 42. The second liquid chamber 52 communicates with the atmosphere through an atmosphere communication section 300, including an atmosphere opening section 44 at one end thereof. The second liquid chamber 52 can store the liquid to be supplied to the first liquid chamber 51.

The coupling flow path 54 couples the first liquid chamber 51 and the second liquid chamber 52, and through which the liquid in the second liquid chamber 52 is supplied to the first liquid chamber 51. The coupling flow path 54 includes, from upstream, a filter chamber 542, an intermediate flow path 544, and a valve chamber 546. The filter chamber 542 is coupled to the second liquid chamber 52. More specifically, the filter chamber 542 has a flow-in opening 548 that is open in the second liquid chamber 52. In other words, the flow-in opening 548 is coupled to the second liquid chamber 52. The filter chamber 542 has a filter member 541 that divides the filter chamber 542 into an upstream section and a downstream section. The filter member 541 captures foreign matter in the liquid flowing from upstream to downstream to inhibit the foreign matter from flowing downstream. Because this structure reduces the possibility of foreign matter entering the liquid ejecting head 12, clogging of the liquid ejecting head 12 and liquid ejection defects are avoided. Furthermore, because the filter chamber 542 is located upstream of the valve chamber 546, the possibility of foreign matter entering the valve chamber 546 is reduced. This structure reduces the possibility of foreign matter causing an opening/closing operation defect of a valve mechanism 60. The filter member 541 is formed of a stainless steel plate with fine pores that block foreign matter while allowing the liquid to pass therethrough. The filter member 541 may be made of another material as long as the filter member 541 can block foreign matter while allowing the liquid to pass therethrough.

The intermediate flow path 544 communicates between the filter chamber 542 and the valve chamber 546. The valve chamber 546 has an inlet opening 547 coupled to the first liquid chamber 51. In other words, the inlet opening 547 serves as one end (downstream end) of the coupling flow path 54. The inlet opening 547 is a through-hole having a circular section. The valve chamber 546 accommodates a portion of the valve mechanism 60 that opens and closes the inlet opening 547 to control the flow of the liquid from the second liquid chamber 52 to the first liquid chamber 51. When the valve mechanism 60 is open, the second liquid chamber 52 and the first liquid chamber 51 communicate with each other, and the liquid in the second liquid chamber 52 flows into the first liquid chamber 51. When the valve mechanism 60 is closed, the second liquid chamber 52 and the first liquid chamber 51 do not communicate with each other.

The valve mechanism 60 includes a valve body 64, a rod 67, a pressure receiving plate 68, a first urging member 62, and a second urging member 65. The valve body 64 is a disc-like member disposed in the valve chamber 546. The valve body 64 is opposed to the inlet opening 547 with a ring-like seal member 66 therebetween. The seal member 66 is disposed on the circumference of the inlet opening 547 so as to surround the inlet opening 547. When the valve body 64 is in contact with the seal member 66, the valve chamber 546 and the first liquid chamber 51 do not communicate with each other. When the valve body 64 is separated from the seal member 66, the valve chamber 546 and the first liquid chamber 51 communicate with each other. The rod 67 is a stick-like member having one end coupled to the valve body 64 and the other end coupled to the pressure receiving plate 68. The rod 67 extends through the inlet opening 547. The pressure receiving plate 68 is a disc-like member. The pressure receiving plate 68 receives an urging force from the first urging member 62 and the second urging member 65 and is in contact with a flexible first film 91, which divides the first liquid chamber 51.

The first urging member 62 is a compression coil spring disposed in the valve chamber 546. The first urging member 62 urges the valve body 64 toward the seal member 66. The second urging member 65 is a compression coil spring disposed in the first liquid chamber 51. The second urging member 65 urges the pressure receiving plate 68 toward the first film 91. When the liquid in the first liquid chamber 51 is supplied to and consumed by the liquid ejecting head 12, and the pressure inside the first liquid chamber 51 becomes negative, the first film 91 urges the pressure receiving plate 68, the rod 67, and the valve body 64 in a direction away from the seal member 66 and the inlet opening 547, against the urging force from the first urging member 62 and the second urging member 65. As a result, the valve body 64 is separated from the seal member 66, opening the valve mechanism 60 and allowing the valve chamber 546 and the first liquid chamber 51 to communicate with each other. When, in this state, the liquid is supplied from the second liquid chamber 52 to the first liquid chamber 51, and the pressure inside the first liquid chamber 51 increases to some extent (e.g., higher than a negative pressure), the first urging member 62 and the second urging member 65 urge the valve body 64 toward the seal member 66, and the valve body 64 comes into contact with the seal member 66. As a result, the valve mechanism 60 is closed, and the valve chamber 546 and the first liquid chamber 51 are brought into a non-communication state. As described above, because the valve mechanism 60 is opened when at least the pressure inside the first liquid chamber 51 becomes negative, the pressure inside the first liquid chamber 51 is stabilized. More specifically, compared with a case where a valve mechanism that is opened when the pressure difference between upstream and downstream of the valve body 64 exceeds a predetermined value is used, variation in the pressure inside the first liquid chamber 51 depending on the difference between the height of the nozzle holes in the liquid ejecting head 12 and the height of the liquid surface in the second liquid chamber 52 (head difference) is reduced. Hence, the liquid can be stably supplied from the second liquid chamber 52 to the first liquid chamber 51.

The first liquid chamber 51 can store the liquid to be supplied to the liquid supply section 50. The liquid-communication flow path 80 couples the first liquid chamber 51 and the liquid supply section 50 to supply the liquid stored in the first liquid chamber 51 to the liquid supply section 50. The air-communication flow path 70 couples the first liquid chamber 51 and the liquid supply section 50 to allow the air to flow between the first liquid chamber 51 and the liquid supply section 50.

The liquid supply section 50 has a liquid supply port 505 at the downstream end. The liquid supply port 505 receives the liquid-introduction needle 122. The liquid supply section 50 is removably coupled to the liquid-introduction needle 122 of the liquid ejecting head 12. More specifically, by inserting the liquid-introduction needle 122 into the liquid supply section 50 through the liquid supply port 505 in the liquid supply section 50, the liquid supply section 50 and the liquid-introduction needle 122 are coupled to each other. In this state, the liquid can be supplied from the liquid supply section 50 to the liquid-introduction needle 122.

The liquid supply section 50 accommodates a supply-section valve mechanism 200 that opens and closes a flow path in the liquid supply section 50. The supply-section valve mechanism 200 includes, from downstream, a valve seat 202, a valve body 203, and a spring 204.

The valve seat 202 is a substantially ring-like member. The valve seat 202 is made of, for example, an elastic member, such as rubber or elastomer. The valve seat 202 is press-fitted into the liquid supply section 50. The valve body 203 is a substantially cylindrical member. The valve body 203 closes a hole (valve hole) in the valve seat 202 before the liquid tank 30 is loaded on the carriage 19 (pre-attachment state). The spring 204 is a compression coil spring. The spring 204 urges the valve body 203 toward the valve seat 202. In an attached state, in which the liquid tank 30 is loaded on the carriage 19 and in which the liquid supply section 50 is coupled to the liquid-introduction needle 122, the liquid-introduction needle 122 presses the valve body 203 upstream, moving the valve body 203 away from the valve seat 202. As a result, the supply-section valve mechanism 200 is opened, allowing the liquid to be supplied from the liquid supply section 50 to the liquid-introduction needle 122.

3. Detailed Structure of Liquid Tank 30

Figure 4:
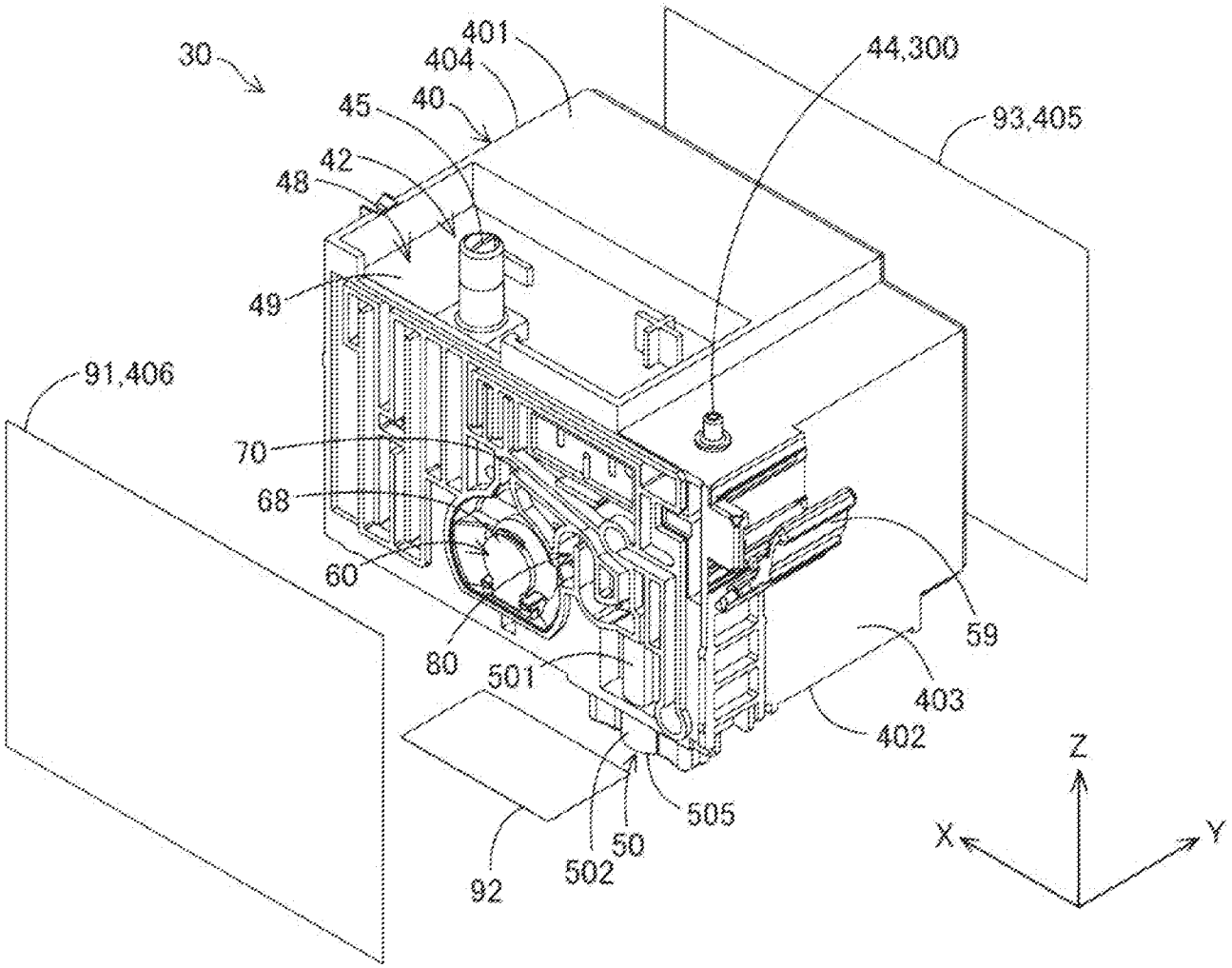
FIG. 4 is a partially exploded perspective view of the liquid tank.
Figure 5:
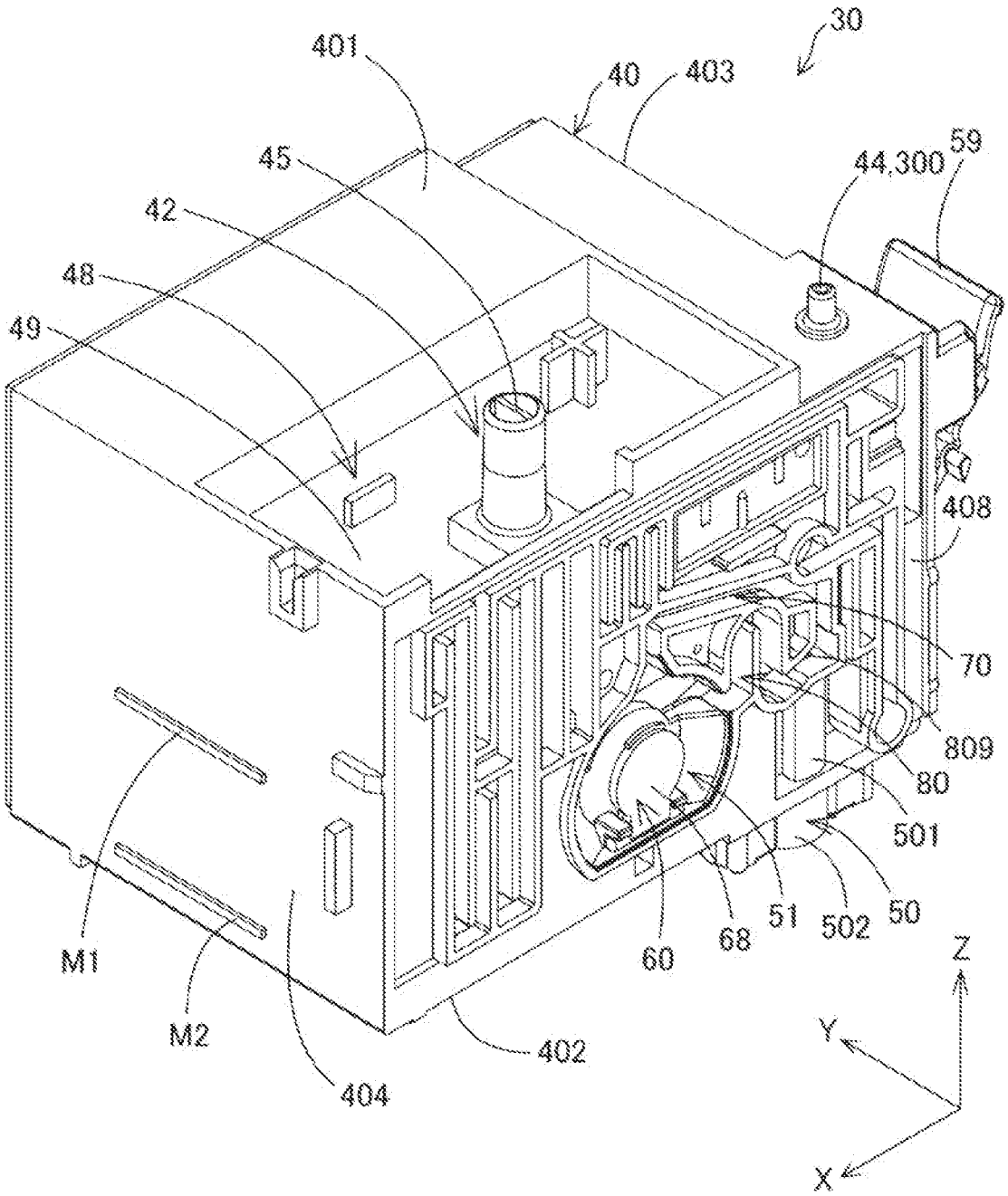
FIG. 5 is a first perspective view of a tank body.
Figure 6:
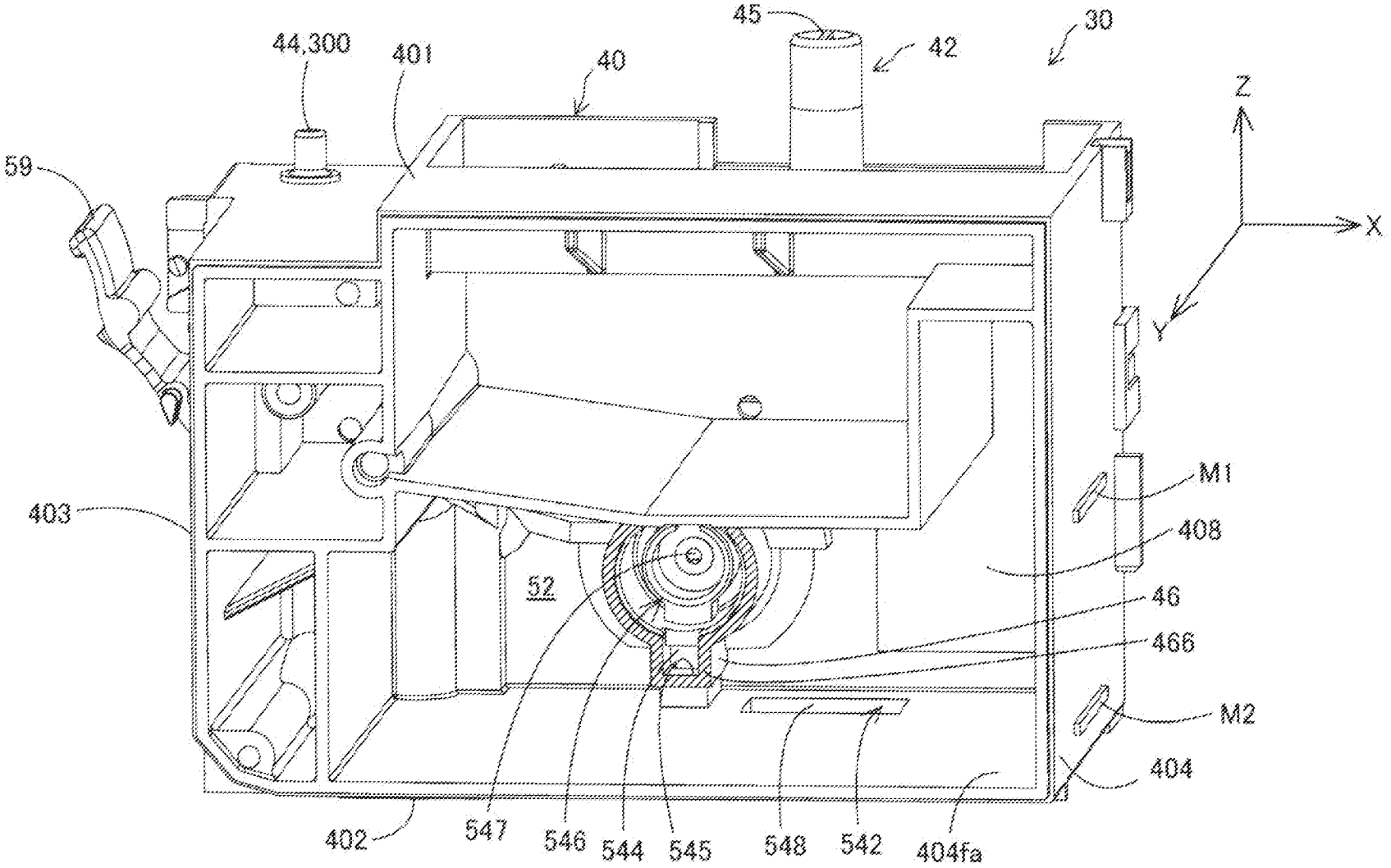
FIG. 6 is a second perspective view of the tank body.
Figure 7:
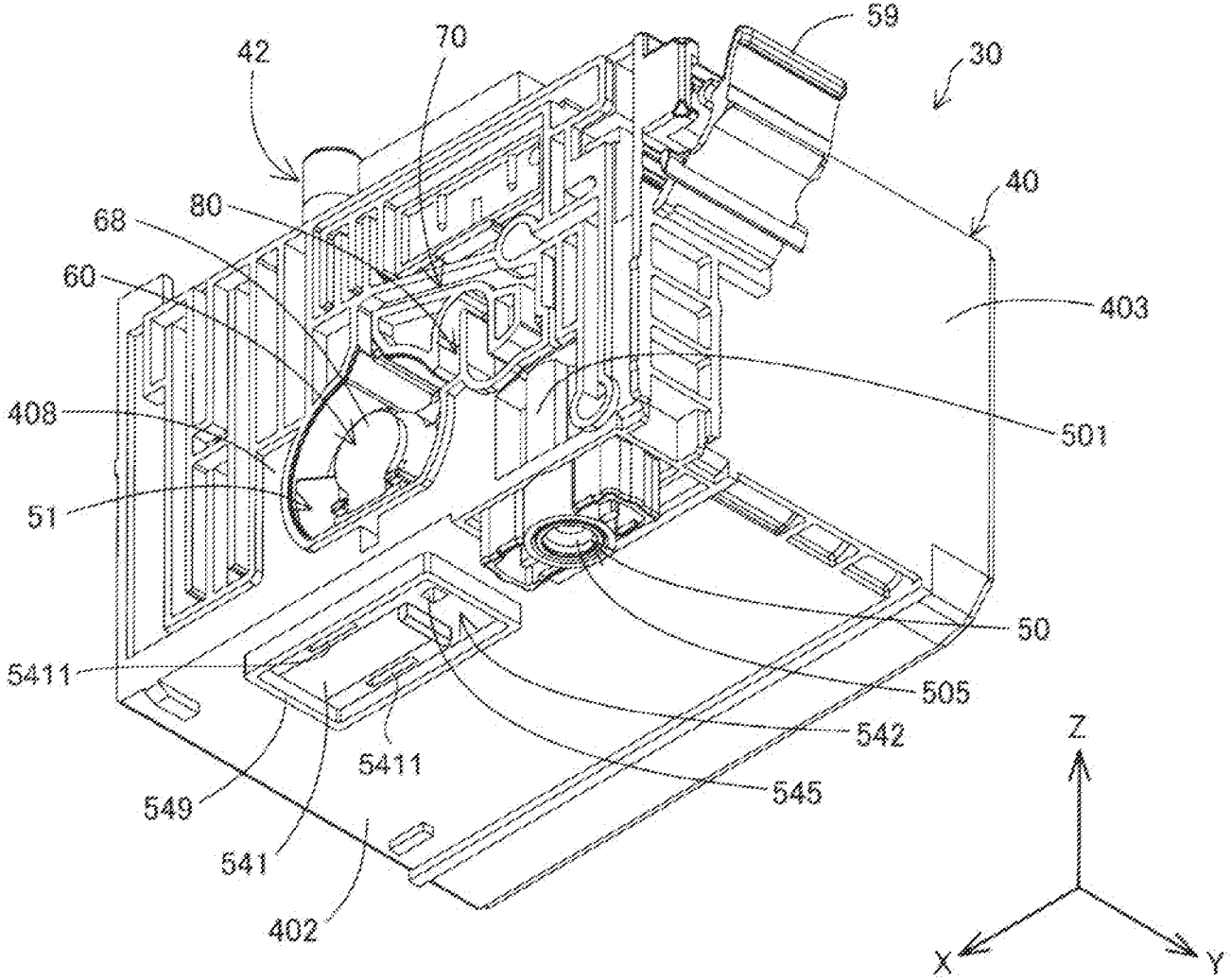
FIG. 7 is a third perspective view of the tank body.
Figure 8:
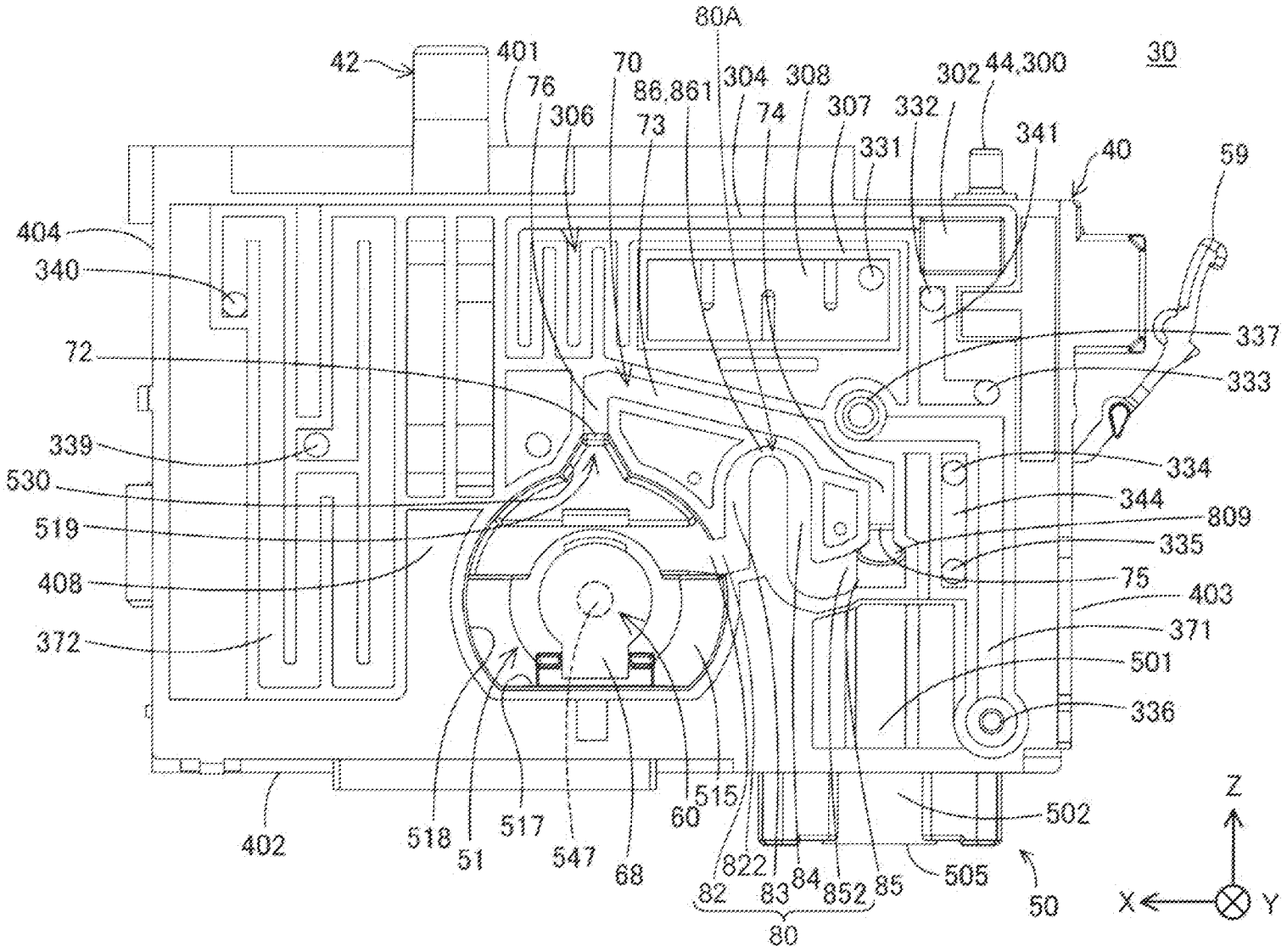
FIG. 8 is a first diagram of the tank body as viewed from the +Y side.
Figure 9:
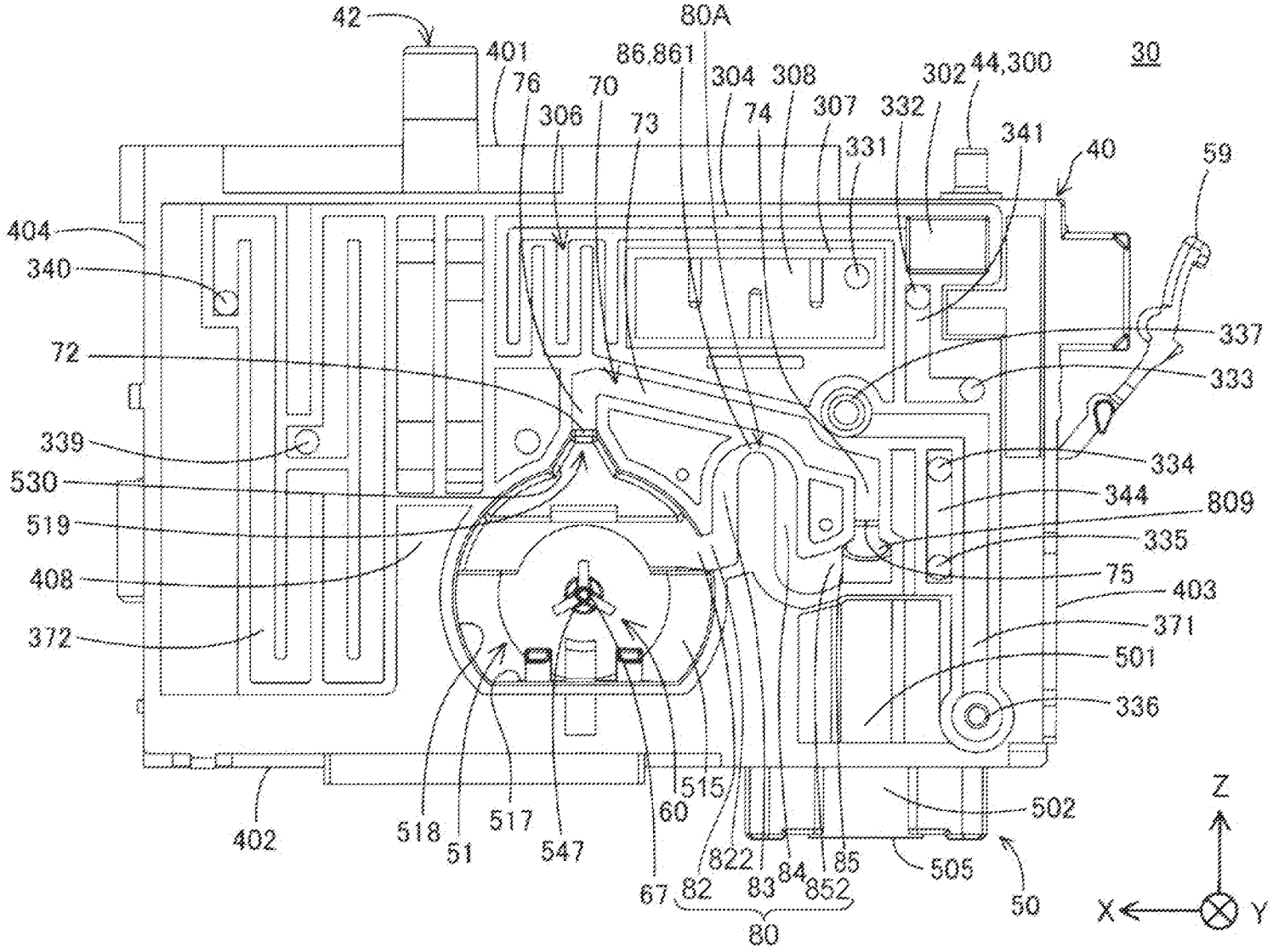
FIG. 9 is a second diagram of the tank body as viewed from the +Y side.
Figure 10A:
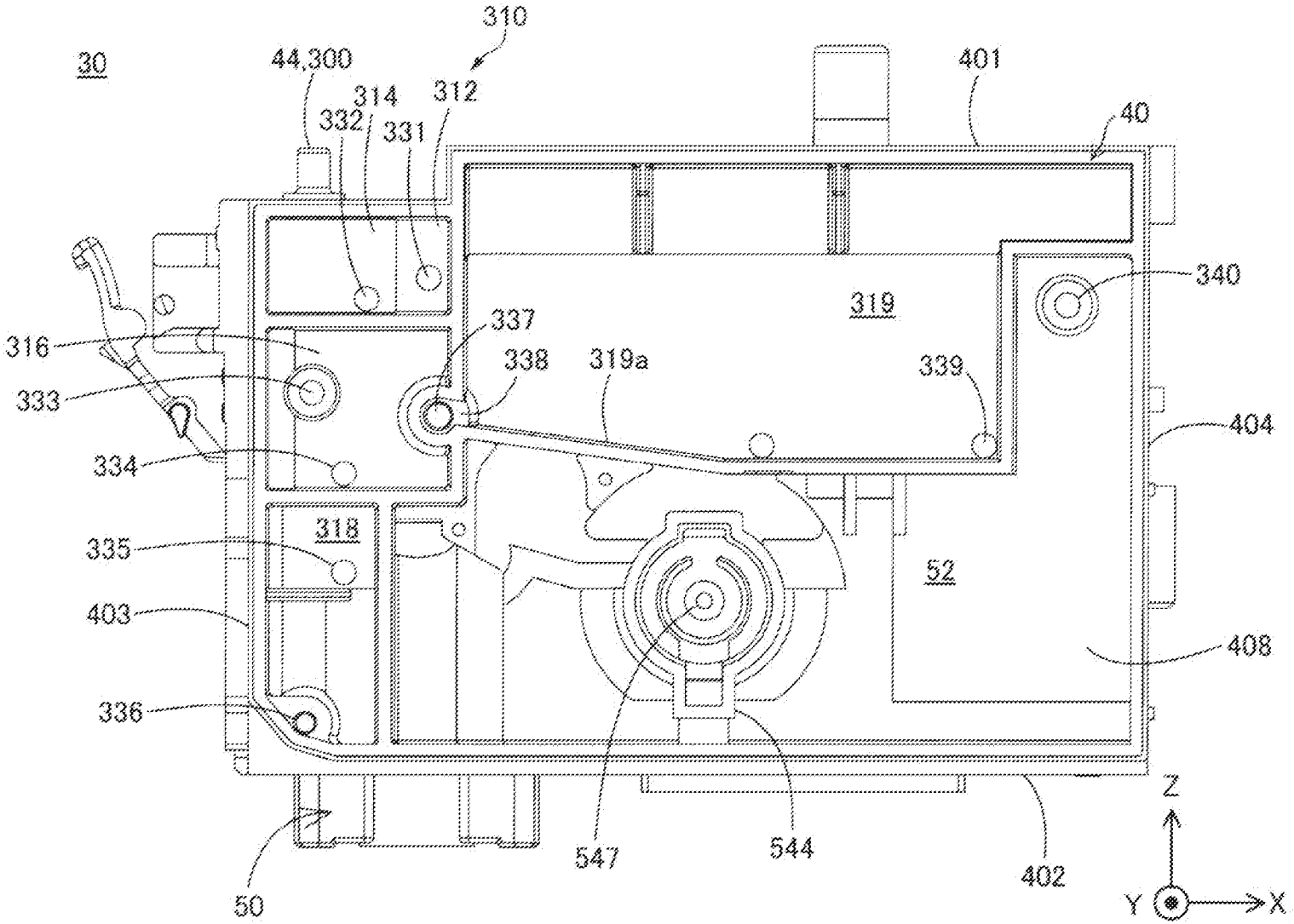
FIG. 10A shows the tank body as viewed from the −Y side.
Figure 10B:
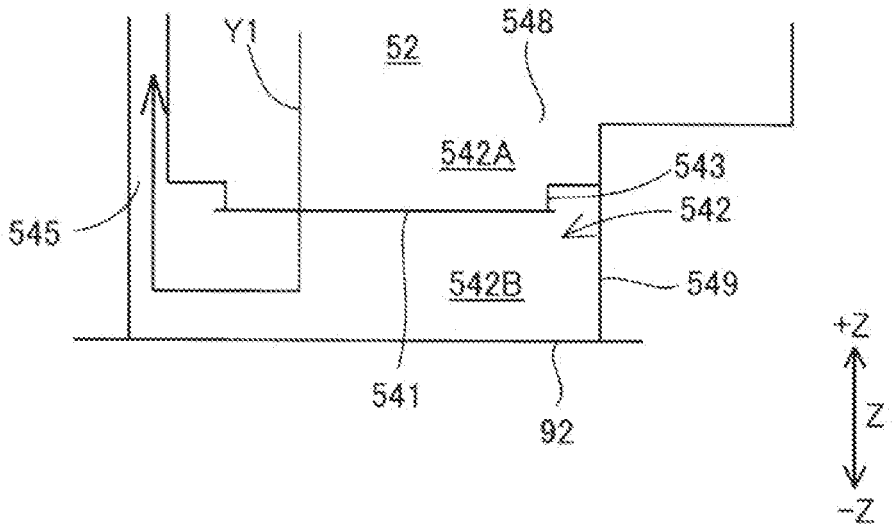
FIG. 10B schematically shows a filter chamber.

FIG. 4 is a partially exploded perspective view of the liquid tank 30. FIG. 5 is a first perspective view of a tank body 40. FIG. 6 is a second perspective view of the tank body 40. FIG. 7 is a third perspective view of the tank body 40. FIG. 8 is a first diagram of the tank body 40 as viewed from the +Y side. FIG. 9 is a second diagram of the tank body 40 as viewed from the +Y side. FIG. 10A shows the tank body 40 as viewed from the −Y side. FIG. 10B schematically shows the filter chamber 542. In FIG. 9, the rod 67 of the valve mechanism 60 is illustrated.

As shown in FIG. 4, the liquid tank 30 includes the tank body 40, the first film 91, a second film 92, and a third film 93. The liquid tank 30 has a substantially rectangular parallelepiped shape. In the liquid tank 30, the X-axis direction corresponds to the length direction, the Y-axis direction corresponds to the width direction, and the Z-axis direction corresponds to the height direction.

The liquid tank 30 has a top surface (a first surface, a first wall) 401, a bottom surface (a second surface, a second wall) 402, a back surface (a third surface, a third wall) 403, a front surface (a fourth surface, a fourth wall) 404, a left side surface (a fifth surface, a fifth wall) 405, and a right side surface (a sixth surface, a sixth wall) 406. In the attached state, in which the liquid tank 30 is attached to the carriage 19, the top surface 401 and the bottom surface 402 are opposed to each other in the Z-axis direction. In the attached state, the back surface 403 and the front surface 404 are opposed to each other in the X-axis direction. In the attached state, the left side surface 405 and the right side surface 406 are opposed to each other in the Y-axis direction. The third film 93 serves as the left side surface 405. The first film 91 serves as the right side surface 406. The top surface 401, the bottom surface 402, the back surface 403, and the front surface 404 are portions of the tank body 40. The back surface 403, the front surface 404, the left side surface 405, and the right side surface 406 are substantially perpendicular to the installation surface of the liquid ejecting apparatus 1. The top surface 401 and the bottom surface 402 are substantially parallel to the installation surface of the liquid ejecting apparatus 1. The surfaces 401 to 406 do not necessarily have to be exactly flat surfaces but may have recesses, projections, etc., and the surfaces 401 to 406 are almost perpendicular/parallel to the installation surface in external view. The front surface 404 serves as a view surface, through which the liquid level in the liquid tank 30 (more specifically, the second liquid chamber 52) can be viewed from the outside. For example, the front surface 404 (view surface) is formed of a transparent or semi-transparent member. The front surface 404 may have indicators (for example, graduations or marks) corresponding to the references (for example, the upper limit and the lower limit) of the liquid level (liquid surface). In this embodiment, as shown in FIG. 5, the front surface 404 has the upper-limit indicator M1, which corresponds to the upper limit, and the lower-limit indicator M2, which corresponds to the lower limit. For example, when a user pours the liquid from the liquid injection portion 42, the user stops pouring when the liquid surface reaches the upper-limit indicator M1, corresponding to the upper limit. Similarly, for example, the user pours the liquid from the liquid injection portion 42 into the second liquid chamber 52 when the liquid surface in the liquid tank 30 (more specifically, the second liquid chamber 52) reaches the lower-limit indicator M2.

A lever 59 for attaching/removing the liquid tank 30 to/from the attachment section 11 (FIG. 2) of the carriage 19 is provided on the back surface 403. In the attached state, the lever 59 is engaged with the attachment section 11 to inhibit the liquid tank 30 from coming off from the attachment section 11. The lever 59 is elastically deformable. A user disengages the liquid tank 30 from the attachment section 11 by pressing the lever 59 toward the back surface 403 and elastically deforming the lever 59 toward the back surface 403. By disengaging the lever 59 from the attachment section 11, the liquid tank 30 becomes removable from the attachment section 11.

The tank body 40 has a substantially rectangular parallelepiped shape and is made of a synthetic resin, such as polypropylene or polystyrene. The first film 91, the second film 92, and the third film 93 are attached to different portions of the tank body 40 in an air-tight manner to define, together with the tank body 40, flow paths, etc., for the liquid and the air in the liquid tank 30.

The tank body 40 (FIG. 6) has the shape of a box that is open on the +Y side. The tank body 40 has a one-side wall 408 that constitutes a bottom of the box-shaped tank body 40. The one-side wall 408 divides the first liquid chamber 51 and the second liquid chamber 52.

The one-side wall 408 is substantially parallel to the X-axis direction and the Z-axis direction. As shown in FIG. 5, the first liquid chamber 51, the liquid-communication flow path 80, and the air-communication flow path 70 are formed on one side (−Y side) of the one-side wall 408. As shown in FIG. 6, the second liquid chamber 52 is formed on the other side (+Y side), which is opposite to the one side, of the one-side wall 408. Because this structure allows the first liquid chamber 51, the liquid-communication flow path 80, the air-communication flow path 70, and the second liquid chamber 52 to be efficiently arranged in the space of the liquid tank 30, an increase in size of the liquid tank 30 can be avoided.

As shown in FIGS. 4 and 8, grooves defining the air-communication flow path 70 and the liquid-communication flow path 80, and a recess constituting the first liquid chamber 51 are formed on the −Y side of the one-side wall 408. By attaching the first film 91 to a −Y-side end face of the one-side wall 408 in an air-tight manner, the first liquid chamber 51, the air-communication flow path 70, and the liquid-communication flow path 80 are defined. As shown in FIGS. 4 and 6, by attaching the third film 93 to a +Y-side end face of the tank body 40, which faces the one-side wall 408, in an air-tight manner, the second liquid chamber 52 is defined.

The tank body 40 (FIG. 4) also has the liquid injection portion 42. The liquid injection portion 42 extends in the +Z direction from a bottom surface 49 of a corner section 48, at which the top surface 401, the front surface 404, and the right side surface 406 meet. The liquid injection portion 42 is a tubular member and constitutes a first flow path and a second flow path. A partition wall 45 is disposed inside the liquid injection portion 42. The partition wall 45 divides the liquid injection portion 42 into the first flow path and the second flow path. When the liquid is poured, the first flow path serves as a liquid pouring path, through which the liquid flows into the second liquid chamber 52, and the second flow path serves as an air discharging path, through which the air is discharged from the second liquid chamber 52. When the liquid in the liquid tank 30 is used, a cap (not shown) is attached to the liquid injection portion 42. The tank body 40 has the atmosphere opening section 44, which is one end of the atmosphere communication section 300, at the top thereof. The atmosphere communication section 300 has a narrow, groove-like flow path and a buffer chamber in which the liquid can be stored when backflow of the liquid occurs. The other end of the atmosphere communication section 300 is coupled to the second liquid chamber 52. With this structure, when the liquid tank 30 is used, the second liquid chamber 52 communicates with the atmosphere. The atmosphere communication section 300 will be described in detail below.

As shown in FIG. 6, the second liquid chamber 52 has a second liquid-chamber bottom surface 404*fa*, which serves as a bottom surface in the attached state. The second liquid-chamber bottom surface 404*fa* is an inner surface of the bottom surface 402. The second liquid-chamber bottom surface 404*fa* has a flow-in opening 548 penetrating in the vertical direction (Z direction) in the attached state. The flow-in opening 548 is an upstream end of the filter chamber 542 provided in the bottom surface 402.

The filter chamber 542 (FIG. 7) is delimited by a frame-like member 549 projecting from the bottom surface 402, and the second film 92 (FIG. 4) attached to a lower end face of the frame-like member 549 in an air-tight manner. In the attached state, the filter chamber 542 is located below (on the −Z side of) the second liquid chamber 52. The filter member 541 is disposed inside the frame-like member 549. In this embodiment, for example, the filter member 541 is disposed on a frame-like setting section 543 (FIG. 10B) formed inside the frame-like member 549. The filter member 541 is plate-shaped and is perpendicular to the vertical direction (Z direction) in the attached state. A communication opening 545 that communicates with the intermediate flow path 544 is provided in the circumferential portion of the filter member 541 (FIGS. 7 and 10B). As shown by arrow Y1 in FIG. 10B, the liquid in the second liquid chamber 52 flows in the −Z direction through the flow-in opening 548 and the filter member 541, and then flows in the +Z direction through the communication opening 545. After flowing through the communication opening 545, the liquid flows into the intermediate flow path 544. As described above, in the attached state, the filter member 541 (FIG. 10B) divides the filter chamber 542 into a first section 542A, which includes the flow-in opening 548 and is located on the upper side, and a second section 542B, which is located below the first section 542A. In the attached state, the filter member 541 is located below the flow-in opening 548. With this structure, even when bubbles are attached to the filter member 541, the bubbles are guided to the second liquid chamber 52 through the flow-in opening 548. Thus, the possibility of the bubbles flowing into the first liquid chamber 51 and the liquid supply section 50 is low.

Furthermore, as shown in FIG. 7, the filter chamber 542 has communication holes 5411, which communicate with the second liquid chamber 52, on both sides of the filter member 541 in the Y-axis direction; that is, in the carriage 19 moving direction.

When the carriage 19 loaded with the liquid tank 30 (attached state) is reciprocated in the Y-axis direction, bubbles are likely to attach to the filter member 541 due to the vibration of the carriage 19. However, in this embodiment, the bubbles attached to the filter member 541 move in the Y-axis direction as the carriage 19 reciprocates in the Y-axis direction and are guided to the second liquid chamber 52 through either of the communication holes 5411 provided on both sides of the filter member 541 in the Y-axis direction. Hence, the possibility of the bubbles flowing toward the first liquid chamber 51 is low.

The intermediate flow path 544 and the valve chamber 546 (FIG. 6) are formed in the second liquid chamber 52. The intermediate flow path 544 and the valve chamber 546 are delimited by the one-side wall 408, a flow path wall 46 standing from the one-side wall 408 toward the opening (+Y side) of the box-shaped tank body 40, and a film (not shown) attached to a +Y-side end face 466 of the flow path wall 46 in an air-tight manner. The end face 466, to which the film is to be attached, is shown by single hatching.

The intermediate flow path 544 (FIG. 6) extends in the gravity direction (Z-axis direction) in the attached state. The gravity direction is a direction substantially perpendicular to the horizontal direction and is a direction at an angle of 80° to 100° with respect to the horizontal direction. The intermediate flow path 544 extending in the gravity direction in the attached state has a smaller flow-path length than that extending in a direction intersecting the gravity direction. When the liquid in the liquid tank 30 is consumed until the liquid surface reaches the position of the filter member 541, bubbles flow into the flow path downstream of the filter member 541. Hence, the supply of the liquid from the liquid tank 30 to the liquid ejecting head 12 is stopped when the liquid surface reaches the position of the filter member 541. In this embodiment, by reducing the flow-path length of the intermediate flow path 544 coupling the first liquid chamber 51 and the filter chamber 542, the amount of liquid remaining unused in the intermediate flow path 544 is reduced. In another embodiment, the intermediate flow path 544 may extend in a direction having a horizontal component and a vertically upward component.

The valve chamber 546 has a substantially circular shape when the tank body 40 is viewed from the −Y side. The valve chamber 546 has the inlet opening 547. More specifically, the inlet opening 547 is a through-hole penetrating the one-side wall 408.

The first liquid chamber 51 (FIG. 8) is formed on the −Y side of the one-side wall 408 and is delimited by a recess that is open on the −Y side, and the first film 91 (FIG. 4) attached to the −Y-side end face of the recess in an air-tight manner. The dimension of the first liquid chamber 51 in the Y-axis direction is larger than that of the air-communication flow path 70. In other words, the first liquid chamber 51 is deeper than the air-communication flow path 70. The capacity (maximum capacity) of the first liquid chamber 51 is smaller than that of the second liquid chamber 52. The first liquid chamber 51 includes a side wall 515 facing the first film 91, a bottom wall 517 located on the vertically lower side in the attached state, an arc-shaped circumferential wall 518 extending vertically upward from the bottom wall 517 in the attached state, and an uppermost portion 519. The side wall 515 has the inlet opening 547. The circumferential wall 518 has a portion facing the bottom wall 517. The uppermost portion 519 projects from the top of the circumferential wall 518 and is located at the highest position of the first liquid chamber 51 in the attached state.

The uppermost portion 519 is a space having a certain capacity. Preferably, the uppermost portion 519 has a tapered portion 530 having a sectional area gradually decreasing toward the upper side, that is, toward an air-side coupling portion 72, to which the air-communication flow path 70 is coupled. In this embodiment, the uppermost portion 519 has the tapered portion 530. By providing the tapered portion 530, the capacity of the uppermost portion 519 can be made larger than that without the tapered portion 530, without increasing the size of the first liquid chamber 51. This increases the amount of air that can be accommodated in the uppermost portion 519 (air capacity). Because the capacity of the uppermost portion 519 is increased, the liquid and bubbles are inhibited from flowing from the first liquid chamber 51 into the air-communication flow path 70 when the use environment (for example, temperature and air pressure) of the liquid tank 30 changes.

The liquid-communication flow path 80 (FIG. 8) forms an upwardly projecting flow path in the attached state. In this embodiment, the liquid-communication flow path 80 forms an inverted U-shaped flow path in the attached state. The liquid-communication flow path 80 includes, from upstream in the liquid flow direction, an upstream end 822 including an upstream end 82, an upward flow path 83, a liquid intermediate flow path 86, a downward flow path 84, and a downstream end 852 including a downstream end 85.

The upstream end 822 is coupled to the first liquid chamber 51. The upstream end 82 is an opening provided in the circumferential wall 518 of the first liquid chamber 51 and is coupled to the first liquid chamber 51. In the attached state, the upward flow path 83 is located downstream of the upstream end 822 and extends upward in the flow direction. In this embodiment, the upward flow path 83 extends vertically upward from the upstream end 822. In another embodiment, the upward flow path 83 may extend in an oblique direction having an upward component. In the attached state, the inlet opening 547 is provided below the upstream end 82. In other words, the inlet opening 547 is provided at a position closer to the bottom wall 517 than the upstream end 82 is.

When, for example, the liquid contains pigment particles, and the liquid comes into contact with gas and is subjected to a pressure change due to opening and closing of the valve mechanism 60, the pigment particles may agglomerate together to form foreign matter. As described above, because the inlet opening 547 is provided below the upstream end 82 in the attached state, the liquid level does not go below the inlet opening 547. Because the presence of gas around the inlet opening 547 is suppressed, the possibility of generation of foreign matter around the inlet opening 547 is reduced. Hence, the possibility of foreign matter entering the liquid ejecting head 12 is reduced.

The liquid intermediate flow path 86 couples the upward flow path 83 and the downward flow path 84. The liquid intermediate flow path 86 has a liquid-side uppermost portion 861, which is located at the highest position in the liquid-communication flow path 80, in the attached state. In other words, the liquid intermediate flow path 86 is higher than the upstream end 82 and the downstream end 85, which are the ends of the liquid-communication flow path 80, in the attached state. The liquid intermediate flow path 86 changes the direction of the liquid flow from the upward direction to the downward direction and is bent by 180 degrees. The liquid intermediate flow path 86 is located below the highest portion (the upstream end of the air second flow path 73) of the air-communication flow path 70 (described below) in the attached state.

The downward flow path 84 is located downstream of the upward flow path 83 and the liquid intermediate flow path 86 in the flow direction and extends downward in the attached state. In this embodiment, the downward flow path 84 extends vertically downward from the liquid intermediate flow path 86. In another embodiment, the downward flow path 84 may extend in an oblique direction having a downward component.

The downstream end 852 is located downstream of the downward flow path 84 in the flow direction and is coupled to the liquid supply section 50 (liquid inlet 809) and the air-communication flow path 70 (supply-side coupling portion 75). The downstream end 852 is formed as a coupling chamber that couples the downward flow path 84 and the liquid inlet 809 (described below) of the liquid supply section 50. The downstream end 852 includes the downstream end 85, to which the liquid inlet 809 is coupled. Preferably, in the attached state, the downstream end 852 is inclined with respect to the horizontal direction such that a portion closer to the liquid supply section 50, that is, the downstream end 85, is higher. More preferably, the inclination of the downstream end 852 with respect to the horizontal direction is from 10° to 45°. In this embodiment, the inclination of the downstream end 852 with respect to the horizontal direction is 15°. Herein, the inclination of the downstream end 852 is the angle (acute angle) formed between the bottom surface of the downstream end 852 and the horizontal direction. When the downstream end 852 is inclined in this manner, entry of bubbles remaining in the liquid supply section 50 into the liquid-communication flow path 80 is suppressed. Hence, clogging of the liquid-communication flow path 80 with bubbles is suppressed.

Now, the structure of the liquid-communication flow path 80 will be described in more detail.

As shown in FIG. 8, the liquid-communication flow path 80 has, at an intermediate position thereof, a narrow portion 80A, in which the sectional area of the liquid-communication flow path 80 is small. The sectional area of the liquid-communication flow path 80 is the area of the flow path taken at a plane perpendicular to the direction in which the fluid (liquid) flows through the liquid-communication flow path 80.

The narrow portion 80A is provided upstream of the downstream end 852 in the liquid-communication flow path 80. In this embodiment, the narrow portion 80A is provided between the upward flow path 83 and the downward flow path 84. More specifically, the narrow portion 80A is provided at the liquid-side uppermost portion 861 of the liquid intermediate flow path 86, which is the highest position in the liquid-communication flow path 80.

The narrow portion 80A is formed so as to have a gradually changing sectional area; that is, the narrow portion 80A is formed such that the sectional area of the liquid-communication flow path 80 gradually decreases.

In the liquid ejecting apparatus 1 according to this embodiment, a plurality of liquid tanks 30 are attached to the attachment section 11 of the carriage 19. By driving the suction pump 16 of the discharge section 18, the liquid is discharged from the first liquid chamber 51 of each liquid tank 30 toward the liquid ejecting head 12 through the liquid-communication flow path 80 and the liquid supply section 50. With this structure, compared with a case where liquid discharging of a single liquid tank 30 is performed with a single suction pump 16, the flow rate of the liquid inside the liquid-communication flow path 80 in each liquid tank 30 is low. Hence, the sectional area of the liquid-communication flow path 80 needs to be reduced so as to correspond to a decrease in the flow rate, that is, the flow path needs to be narrowed. In this embodiment, to ensure the liquid-discharging capacity, the sectional area of the liquid-communication flow path 80 in the liquid tank 30 is reduced in accordance with the capacity of the suction pump 16.

When the sectional area of the liquid-communication flow path 80 is uniformly reduced, air (bubbles) that has entered the liquid-communication flow path 80 is likely to be trapped when, for example, the liquid tank 30 is tilted. In addition, concern is that the air in the liquid-communication flow path 80 may flow toward the liquid supply section 50 at an unexpected time during print processing. When the bubbles that have flowed out to the liquid supply section 50 move to the liquid ejecting head 12, an ejection defect, such as failure to eject liquid from the liquid ejecting head 12, occurs.

To counter this concern, in this embodiment, besides the reduction in the sectional area of the overall liquid-communication flow path 80, the narrow portion 80A is provided at a portion of the liquid-communication flow path 80. This makes it possible to maintain the pressure loss across the liquid-communication flow path 80 and thus to easily perform liquid discharging.

Furthermore, for example, even when the liquid tank 30 is tilted and air (bubbles) enters the liquid-communication flow path 80, the air can be easily captured at the narrow portion 80A. During print processing of the liquid ejecting apparatus 1, the air in the liquid-communication flow path 80 gradually moves downstream and flows into the air-communication flow path 70 when reaching the downstream end 85. In this way, the air is inhibited from flowing into the liquid supply section 50. Because the air is inhibited from moving to the liquid ejecting head 12, ejection defects, such as failure to eject liquid from the liquid ejecting head 12, are suppressed.

Because the narrow portion 80A has a gradually changing sectional area, the liquid can smoothly flow therethrough.

The narrow portion 80A is provided upstream of the downstream end 852. In a case in which, for example, the narrow portion 80A is provided at the downstream end 852, the air captured at the narrow portion 80A may easily move toward the liquid supply section 50 when, for example, the suction pump 16 is driven. By providing the narrow portion 80A at a portion other than the downstream end 852, movement of the air toward the liquid supply section 50 is inhibited.

Because the narrow portion 80A is provided at the liquid-side uppermost portion 861, even when the liquid tank 30 is tilted due to, for example, tilting of the liquid ejecting apparatus 1, movement of the air that has entered the liquid-communication flow path 80 is suppressed. In other words, it is possible to inhibit the air that has entered the liquid-communication flow path 80 from easily moving toward the liquid supply section 50.

The air-communication flow path 70 (FIG. 8) includes: the air-side coupling portion 72, serving as one end; an air first flow path 76, serving as an upward air flow path; an air second flow path 73, serving as a sloping air flow path; an air third flow path 74; and the supply-side coupling portion 75, serving as the other end. In the attached state, the air-communication flow path 70 is coupled to the first liquid chamber 51 at a position above the upstream end 82, at which the liquid-communication flow path 80 and the first liquid chamber 51 are coupled.

The air-side coupling portion 72 is an opening provided at the uppermost portion 519 of the circumferential wall 518. In other words, in the attached state, the air-communication flow path 70 is coupled to the uppermost portion 519 of the first liquid chamber 51. Preferably, in the attached state, the air-side coupling portion 72 is provided above or at the same height as the liquid-side uppermost portion 861 of the liquid-communication flow path 80. In that case, the capacity of the uppermost portion 519 of the first liquid chamber 51 is larger than that in the case where the air-side coupling portion 72 is provided below the liquid-side uppermost portion 861. In this embodiment, the air-side coupling portion 72 is provided above the liquid-side uppermost portion 861.

In the attached state, the air first flow path 76 has the air-side coupling portion 72 at one end thereof and extends upward from the first liquid chamber 51. The air second flow path 73 couples the air first flow path 76 and the air third flow path 74 and extends in a direction having a horizontal component (in this embodiment, the X-axis direction) in the attached state. The air third flow path 74 extends downward from the air second flow path 73 in the attached state. The air third flow path 74 is coupled to the liquid supply section 50 via the supply-side coupling portion 75. The supply-side coupling portion 75 is formed as a coupling chamber coupling the air third flow path 74 and the liquid inlet 809.

Preferably, the air second flow path 73 extends in a direction inclined with respect to the horizontal direction in the attached state. More preferably, the air second flow path 73 is inclined at an angle of 10° to 45° with respect to the horizontal direction. The angle of the air second flow path 73 with respect to the horizontal direction is the angle (acute angle) formed between the bottom surface of the air second flow path 73 and the horizontal direction. Because the air second flow path 73 extends at an angle with respect to the horizontal direction, when the liquid flows into the air second flow path 73, the liquid is likely to flow from the air second flow path 73 to the air first flow path 76 or the air third flow path 74, compared with a case where the air second flow path 73 extends horizontally. Hence, the liquid that has flowed into the air second flow path 73 is inhibited from being trapped therein. Hence, clogging of the air second flow path 73 with the liquid that has flowed therein is suppressed. Entry of the liquid into the air second flow path 73 occurs due to, for example, a temperature change, an air-pressure change, or tilting or vibration of the liquid tank 30. In this embodiment, in the attached state, the overall air second flow path 73 is inclined downward toward the air third flow path 74, at an angle of 15° with respect to the horizontal direction.

Preferably, in the attached state, the supply-side coupling portion 75, which is the downstream end of the air-communication flow path 70, is located directly above the liquid inlet 809 (described below) of the liquid supply section 50. This means that the supply-side coupling portion 75 is arranged so as to at least partially overlap the liquid inlet 809 when viewed from the +Z side. More preferably, the center of the section of the flow path of the supply-side coupling portion 75 and the center of the section of the flow path of the liquid inlet 809 substantially overlap each other. When the supply-side coupling portion 75 is located directly above the liquid inlet 809, compared with a case where the supply-side coupling portion 75 is not located directly above the liquid inlet 809, bubbles remaining in the liquid supply section 50 are likely to move upward and flow into the air-communication flow path 70. Hence, entry of the bubbles remaining in the liquid supply section 50 into the liquid-communication flow path 80 is suppressed. In this embodiment, the supply-side coupling portion 75 is located directly above the liquid inlet 809.

In the attached state, the liquid supply section 50 (FIG. 7) is located below the downstream end 85. In the attached state, the liquid supply section 50 extends downward toward the liquid supply port 505. In this embodiment, the liquid supply section 50 extends vertically downward toward the liquid supply port 505 in the attached state. However, in another embodiment, the liquid supply section 50 may extend in an oblique direction having a downward component.

The liquid supply section 50 (FIG. 8) has the liquid inlet 809, a first supply section 501, and a second supply section 502. The liquid inlet 809 serves as an upstream end of the liquid supply section 50 in the liquid flow direction. In the attached state, the liquid inlet 809 is open to the vertically upward direction. The first supply section 501 forms, inside thereof, a flow path coupled to the liquid inlet 809. The first supply section 501 is formed inside the tank body 40. The second supply section 502 is coupled to the first supply section 501. The second supply section 502 is formed of a member projecting vertically downward from the bottom surface 402 in the attached state. The second supply section 502 has the liquid supply port 505. The liquid supply port 505 is open to the vertically downward direction in the attached state.

As shown in FIG. 8, when the liquid tank 30 is viewed from the +Y side, the liquid injection portion 42 and the liquid supply port 505 are located at diagonal positions. For example, when the liquid tank 30 is viewed from the +Y side, the liquid injection portion 42 is located above the first liquid chamber 51 in the vertical direction and to the +X side of the inlet opening 547 in the first liquid chamber 51 in the horizontal direction (for example, the X-axis direction) in the attached state. The liquid supply port 505 is located below the first liquid chamber 51 in the vertical direction and to the −X side of the inlet opening 547 in the first liquid chamber 51 in the horizontal direction (for example, the X-axis direction) in the attached state. With this structure, the distance between the liquid injection portion 42 and the liquid supply port 505 is not short. Hence, even when bubbles are generated when the liquid is poured into the second liquid chamber 52 from the liquid injection portion 42, the possibility of the bubbles reaching the liquid supply port 505 is low. Because the bubbles remaining in the vicinity of the liquid supply port 505 in the liquid supply section 50 are reduced, the possibility of the bubbles flowing into the liquid ejecting head 12 decreases. Furthermore, because the liquid flow path between the liquid injection portion 42 and the liquid supply port 505 can be efficiently arranged, an increase in the size of the liquid tank 30 can be avoided.

Next, referring to FIGS. 9 and 10A, the atmosphere communication section 300 will be described. The wordings "upstream" and "downstream" used in the description of the atmosphere communication section 300 below are based on the flow direction of the fluid (air) flowing from the outside toward the second liquid chamber 52.

The atmosphere communication section 300 includes, from upstream: the atmosphere opening section 44, serving as an upstream end; a first atmosphere flow path 302; a second atmosphere flow path 304; a winding flow path 306; a gas-liquid separation chamber 308; a buffer chamber 310; an atmosphere intermediate flow path 372; and an atmosphere introduction section 340, serving as a downstream end. In the atmosphere communication section 300, the flow paths formed on one side (−Y side) of the one-side wall 408 are delimited by the tank body 40 and the first film 91 (FIG. 4), and the flow paths formed on the other side (+Y side) of the one-side wall 408 are delimited by the tank body 40 and the third film 93 (FIG. 4). The buffer chamber 310 includes, from upstream: a first buffer chamber 312; a second buffer chamber 314; a third buffer chamber 316; a fourth buffer chamber 318; and a fifth buffer chamber 319.

The atmosphere opening section 44 (FIG. 9) is a tubular member extending in the +Z direction from a portion of the top surface 401 near the back surface 403. The first atmosphere flow path 302 (FIG. 9) couples the atmosphere opening section 44 and the second atmosphere flow path 304. The second atmosphere flow path 304 is a long, narrow flow path extending in the X-axis direction. The winding flow path 306 couples the second atmosphere flow path 304 and the gas-liquid separation chamber 308. The winding flow path 306 is a long, narrow, winding flow path that lengthens the atmosphere communication section 300. This structure suppresses evaporation of the moisture in the liquid in the second liquid chamber 52. A gas-liquid separation film (not shown) is provided on an inner circumferential wall 307 of the gas-liquid separation chamber 308. The gas-liquid separation film is formed of a material that blocks the liquid while allowing the gas to pass therethrough. The downstream end of the gas-liquid separation chamber 308 is a through-hole 331 penetrating the one-side wall 408. The through-hole 331 communicates between the gas-liquid separation chamber 308 and the first buffer chamber 312 (FIG. 10A). The first buffer chamber 312 communicates with the second buffer chamber 314 through the gap between the third film 93 and the +Y-side end face of the tank body 40.

The second buffer chamber 314 and the first intermediate coupling flow path 341 communicate with each other through a through-hole 332 penetrating the one-side wall 408. The downstream end of the first intermediate coupling flow path 341 is a through-hole 333 penetrating the one-side wall 408. The through-hole 333 communicates between the first intermediate coupling flow path 341 and the third buffer chamber 316 (FIG. 10A). The third buffer chamber 316 and the second intermediate coupling flow path 344 communicate with each other through a through-hole 334 penetrating the one-side wall 408. The second intermediate coupling flow path 344 and the fourth buffer chamber 318 communicate with each other through a through-hole 335 penetrating the one-side wall 408. The fourth buffer chamber 318 and the third intermediate coupling flow path 371 communicate with each other through a through-hole 336 penetrating the one-side wall 408. The third intermediate coupling flow path 371 and the fifth buffer chamber 319 communicate with each other through a through-hole 337 penetrating the one-side wall 408 and a cutaway portion 338 provided around the through-hole 337. A bottom surface 319*a* of the fifth buffer chamber 319 is inclined downward from the cutaway portion 338, which is located upstream, toward a through-hole 339, which is located downstream. With this structure, even when the liquid enters the fifth buffer chamber 319 from the through-hole 339, the possibility of the liquid reaching the cutaway portion 338 is low.

The fifth buffer chamber 319 and the atmosphere intermediate flow path 372 communicate with each other through the through-hole 339 penetrating the one-side wall 408. The atmosphere intermediate flow path 372 and the second liquid chamber 52 communicate with each other through the atmosphere introduction section 340 penetrating the one-side wall 408. The atmosphere introduction section 340 is provided near the top surface of the second liquid chamber 52 in the attached state.

4. Structure of Another Liquid Tank 30A

Next, the structure of another liquid tank 30A will be described. More specifically, the structure of a liquid-communication flow path 801 of the liquid tank 30A will be described. Because the structures of portions other than the liquid-communication flow path 801 are the same as those in the above-described embodiment, the descriptions thereof will be omitted.

Figure 11:
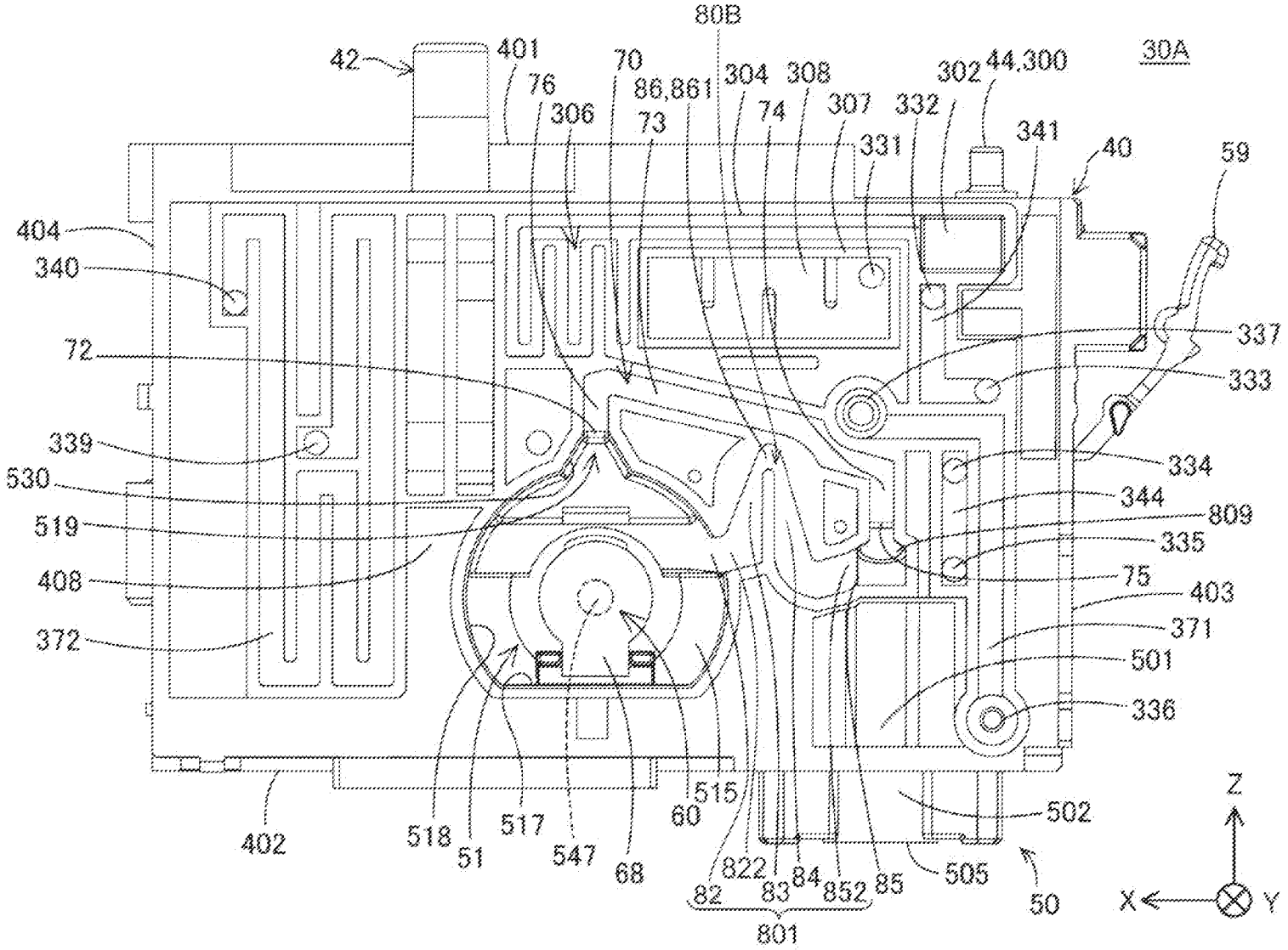
FIG. 11 schematically shows the structure of another liquid tank.

FIG. 11 schematically shows the structure of the liquid tank 30A.

As shown in FIG. 11, the liquid tank 30A has the liquid-communication flow path 801. The liquid-communication flow path 801 forms an inverted U-shaped flow path in the attached state. The liquid-communication flow path 801 includes, from upstream in the liquid flow direction, the upstream end 822 including the upstream end 82, the upward flow path 83, the liquid intermediate flow path 86, the downward flow path 84, and the downstream end 852 including the downstream end 85.

The liquid-communication flow path 801 has, at an intermediate position thereof, a narrow portion 80B, in which the sectional area of the liquid-communication flow path 801 is small. More specifically, in the narrow portion 80B, the sectional area gradually decreases from the upstream end 822 toward the upper end of the upward flow path 83. The sectional area also gradually decreases from the downstream end 852 toward the upper end of the downward flow path 84. That is, the sectional area is smallest at the liquid-side uppermost portion 861.

Also with this structure, the pressure loss across the liquid-communication flow path 801 is maintained, and the same advantage as that of the above-described embodiment can be obtained.

5. Other Embodiments

Although the liquid ejecting apparatus 1 having an on-carriage structure, in which the liquid tanks 30 or 30A are loaded on the carriage 19, has been described in the above-described embodiment, the present disclosure may also be applied to a liquid ejecting apparatus having an off-carriage structure, in which the liquid tanks 30 or 30A are not loaded on the carriage 19. Also with the off-carriage structure, the same advantages as those of the above-described embodiment can be obtained.

What is claimed is:

1. A liquid tank configured to be attached to a liquid ejecting apparatus having a liquid ejecting head, the liquid tank comprising:

a liquid supply section that supplies liquid to the liquid ejecting head;

a liquid chamber configured to store the liquid to be supplied to the liquid supply section;

a liquid-communication flow path that couples the liquid chamber and the liquid supply section, through which the liquid stored in the liquid chamber is configured to be supplied to the liquid supply section, and that forms an upwardly projecting flow path in an attached state in which the liquid tank is attached to the liquid ejecting apparatus; and an air-communication flow path that couples the liquid chamber and the liquid supply section, through which air is configured to flow between the liquid chamber and the liquid supply section, and that is coupled, in the attached state, to the liquid chamber at a position above a coupling position between the liquid-communication flow path and the liquid chamber, wherein the liquid-communication flow path has, in a liquid flow direction from the liquid chamber toward the liquid ejecting head, an upstream end coupled to the liquid chamber, an upward flow path located downstream of the upstream end and extending upward in the attached state, a downward flow path located downstream of the upward flow path and extending downward in the attached state, and a downstream end located downstream of the downward flow path and coupled to the liquid supply section and the air-communication flow path, the liquid-communication flow path has, at an intermediate position of the liquid-communication flow path, a narrow portion in which a sectional area of the liquid-communication flow path is small, and the liquid-communication flow path is formed such that the sectional area continuously decreases starting from the upstream end to an upper end of the upward flow path and such that the sectional area continuously decreases starting from the downstream end to an upper end of the downward flow path.

2. The liquid tank according to claim 1, wherein the narrow portion is formed such that the sectional area gradually changes.

3. The liquid tank according to claim 1, wherein the narrow portion is provided upstream of the downstream end.

4. The liquid tank according to claim 3, wherein the narrow portion is disposed between the upward flow path and the downward flow path.

5. A liquid ejecting apparatus comprising:

the liquid tank according to claim 1; and a liquid ejecting head that ejects liquid supplied from the liquid tank.

* * * * *